US006709030B2

(12) United States Patent
Furlong

(10) Patent No.: US 6,709,030 B2
(45) Date of Patent: Mar. 23, 2004

(54) WATER-RESISTANT SLAM-LATCH

(75) Inventor: Donn Furlong, Marysville, WA (US)

(73) Assignee: Marine Hardware, Inc., Redmond, WA (US)

( * ) Notice: Subject to any disclaimer, the term of this patent is extended or adjusted under 35 U.S.C. 154(b) by 0 days.

(21) Appl. No.: 10/179,711

(22) Filed: Jun. 24, 2002

(65) Prior Publication Data

US 2003/0234542 A1 Dec. 25, 2003

(51) Int. Cl.[7] ..... E05C 19/10
(52) U.S. Cl. ..... 292/121; 70/208; 292/175
(58) Field of Search ..... 292/124, 125, 292/165, 169, 170, 175, DIG. 31; 70/208

(56) References Cited

U.S. PATENT DOCUMENTS 3,449,005 A * 6/1969 Pastva ..... 292/173
4,116,027 A * 9/1978 Tannery ..... 70/472
5,413,391 A * 5/1995 Clavin ..... 292/170
5,484,178 A * 1/1996 Sandhu ..... 292/173
6,109,669 A * 8/2000 Pinkow ..... 292/175
6,152,501 A * 11/2000 Magi ..... 292/336.3
6,174,007 B1 * 1/2001 Schlack ..... 292/336.3

* cited by examiner

*Primary Examiner*—Gary Estremsky
(74) *Attorney, Agent, or Firm*—Jensen & Puntigam PS

(57) ABSTRACT

A latch for use on boats or the like, presenting a substantially water impervious exterior. The unlatching element is mounted to the exterior by an axle, which is mounted horizontally and extends through the face of the latch at a portion that is substantially vertical when mounted and further substantially filled with the axle or a securement device. The axle rotates with the latch and operates a cam that directly moves the latch element.

3 Claims, 3 Drawing Sheets

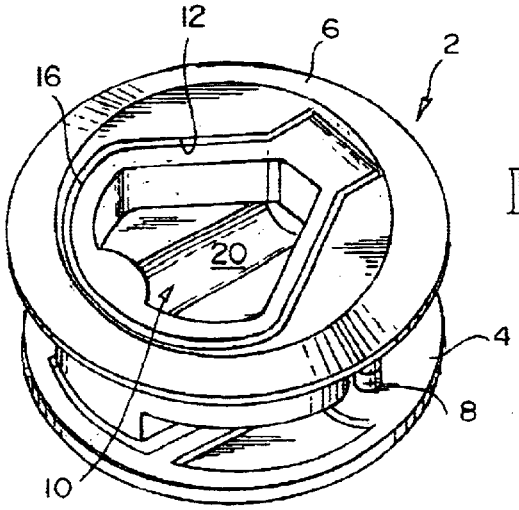
FIG. 1
FIG. 2
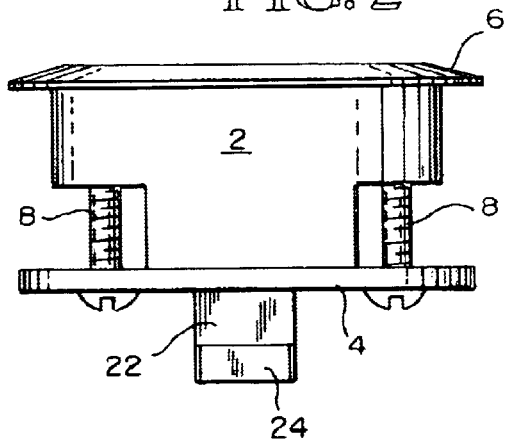
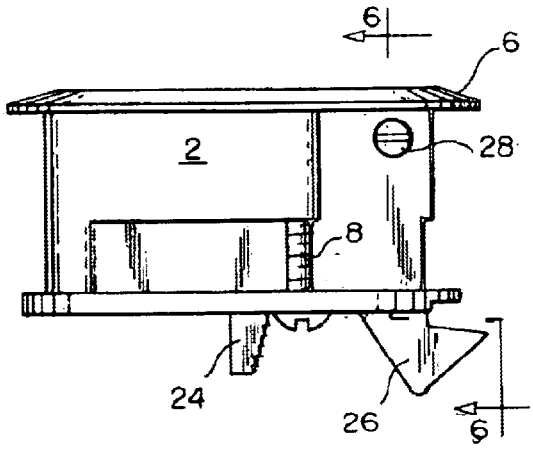
FIG. 3
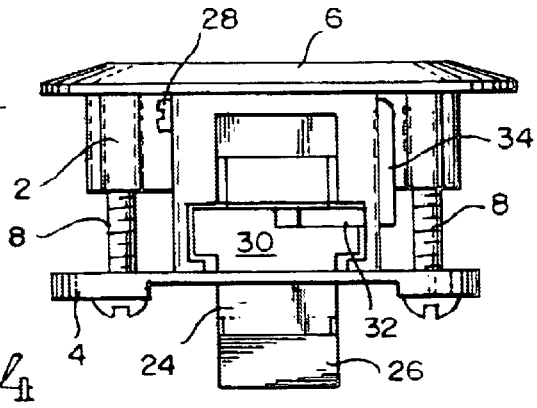
FIG. 4

FIG. 5
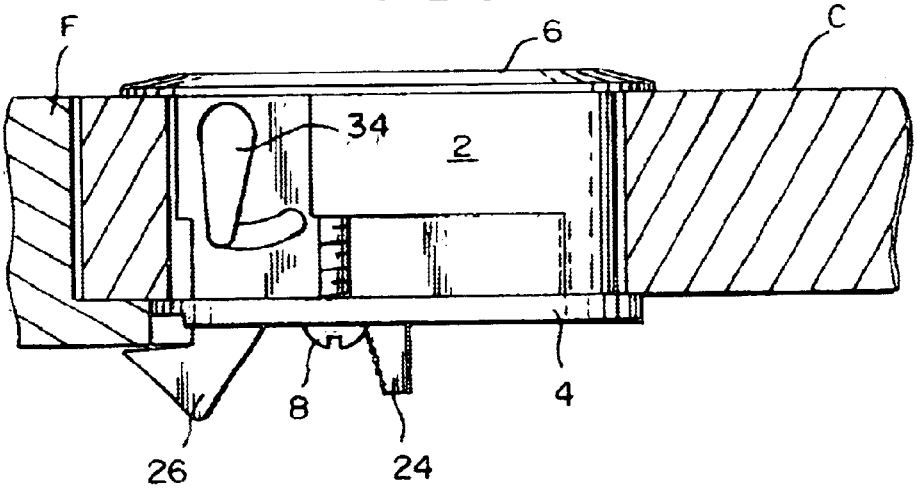
FIG. 6
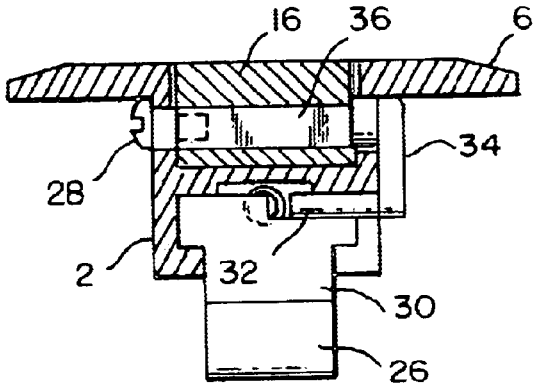
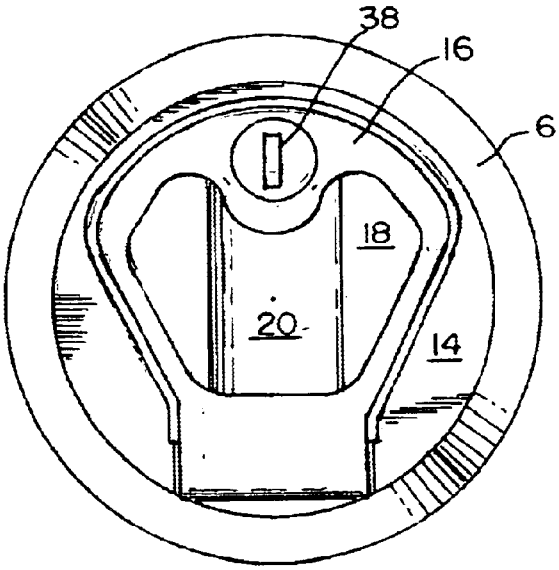
FIG. 7

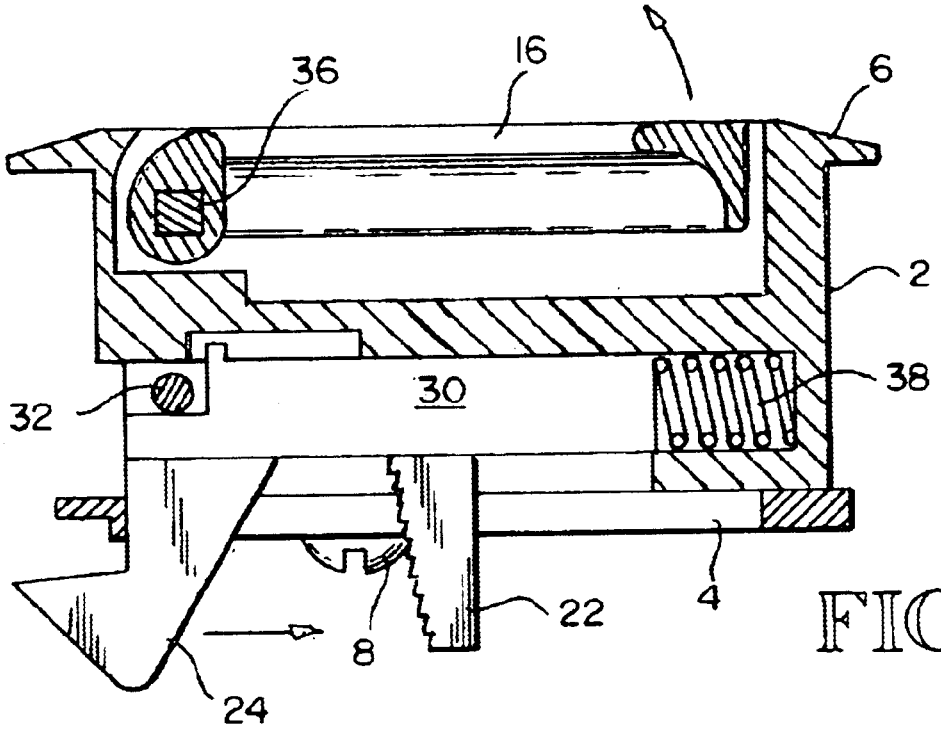
FIG. 8
FIG. 9
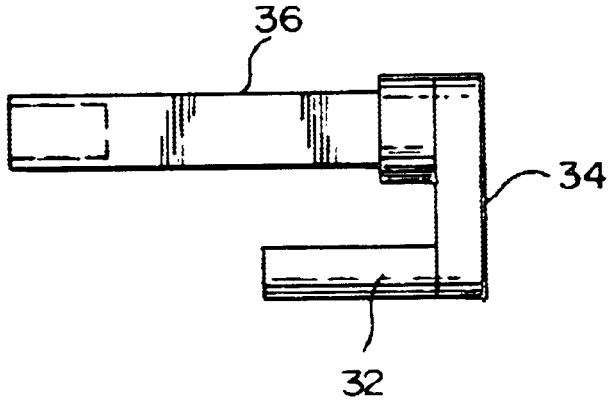

WATER-RESISTANT SLAM-LATCH

TECHNICAL FIELD

This invention relates to latches for closure members and more particularly to a simple latch, the exterior of which makes the latch water-resistant, adapting it for use in conditions where it will be exposed to water, such as on a boat.

The pull-handle of the latch is mounted to a horizontal axle that moves therewith, extending through the sidewalls of the faceplate, moving a lever arm, which in turn opens the latch.

BACKGROUND OF THE INVENTION

Slam-latch closures are well known in the boating industry and have been in use for an extremely long time. Likewise, latch-type closures for use on boats and/or storage devices are old and well known. However, these devices are not without drawbacks; subjected to water under pressure, the latch mechanisms leak.

Prior references known to the inventor include:

U.S. Pat. No. 2,987,908, granted Jun. 13, 1961 to Pelcin, which discloses a slam-latch type door lock, wherein the latch is moved from its locked to unlocked position via a trigger or lever which extends through the center portion of the face plate.

U.S. Pat. No. 3,389,932 granted to Pastua, Jun. 25, 1968, shows a slam-latch type door lock, wherein the end of the latch extends through the back of the face plate to move the latch member.

U.S. Des. Pat. No. 180,260 granted to Adams, et al., May 14, 1957, discloses a sliding door lock wherein the lock is activated by a rotating member.

U.S. Des. Pat. No. 324,636 granted to Schlack, et al., Mar. 17, 1992, discloses a slam-latch wherein the latch member extends through the faceplate to activate the latch element.

U.S. Des. Pat. No. 357,396 granted to Ziemer, et al., Apr. 18, 1995, discloses a slam-latch without sufficient information as to the mechanism.

U.S. Des. Pat. No. 370,620 granted to Ziemer, Jun. 11, 1996, discloses a lockable slam-latch wherein the latch element is operated by an extension of the handle passing through the faceplate.

SUMMARY OF THE INVENTION

With the above-noted summary of the invention, prior art and problems in mind, it an object of the present invention to provide a slam-latch for use in securing closures wherein the slam-latch is highly water-resistant.

It is another object of the present invention to provide a slam-latch for securing closures wherein the latch body extends through the closure and the mechanism is designed such that it provides very little opportunity for water seepage.

A still further object of the present invention is to provide the opening mechanism for a slam-latch that extends through portions of the face of the slam-latch, which are not ordinarily subjected to direct water pressure.

BRIEF DESCRIPTION OF THE DRAWINGS

FIG. 1 is an isometric view of the inventive slam-latch.

FIG. 2 is a bottom view of the inventive slam-latch.

FIG. 3 is a side elevation of the slam-latch.

FIG. 4 is a top view of the slam-latch.

FIG. 5 is another side elevation of the slam-latch.

FIG. 6 is a section line along line 6—6 of FIG. 3.

FIG. 7 is a front view of the slam-latch, including a lock mechanism.

FIG. 8 is a sectional view through the side of the slam-latch.

FIG. 9 is an enlarged view of the cam axle.

BEST MODE FOR CARRYING OUT THE INVENTION

As seen in FIG. 1, the slam-latch of the present invention includes a main body portion 2 which is mounted into a simple, circular hole in the closure extending therethrough and secured in place by a clamp plate 4 which abuts the back of the closure opposite the outwardly extending flange 6 on the main body portion. The main body portion and clamp plate are secured together by screw members 8. In addition to the radially outwardly extending flange 6, the main body portion includes an inwardly extending cavity or depressed portion 10 including sides 12 of an irregular profile substantially perpendicular to face portion 14 to receive a pull lever 16 which is substantially co-planar with the exterior of the closure member when the latch is in its closed position. The inwardly extending side walls 12 are unitary with the body element 18, which includes a further downwardly extending trough 20, as further defined hereinafter.

Reference is now had to FIG. 2 wherein the lower surface (when mounted) of the slam-latch is shown, and it can be seen that the flange 6 extends outwardly from the body 2 to abut the outer portion of the cover and the clamp plate 4 abuts the inner portion of the cover securing the latch in place. The body portion 2 is cylindrical so that the preparation for the mounting of the slam-latch involves no more than placing an appropriately sized bore through the cover. It is to be noted that the latch or slide portion of the slam-latch extends rearwardly of the clamp plate 4 and includes an outwardly extending projection 22, wherein as explained hereinafter allows opening the latch from the interior of the closure, as well as the latch element itself 24, which when in the closed position overlaps an appropriate element on the interior surface of the framework surrounding the closure and securing the closure in place.

Reference is now had to FIG. 3, wherein similar elements are similarly labeled as viewed from the right side of the latch, and further to be seen in this view is a screw 28 for holding the operating mechanism in position, as well as a better view of the profile of the latch 26, which is well known in the art.

Reference is now had to FIG. 4, which is a top view and more clearly shows the exposed portion of the operating mechanism, and in particular, shows the top of the slide member 30, which is integral with the latch 26 and thumb operation element 24. Slide element 30 is urged to its uppermost position as shown by means of a spring, not shown in this figure, mounted beneath the slide element. The slide element 30 is urged against the upper force of the spring 30 by means of a cam 32 rigidly secured to lever arm 34, which is rigidly secured to the axle extending through the pull lever 16 (not seen in this view), as will be explained hereinafter.

FIG. 6 is a sectional view taken along line 6—6 of FIG. 3 and more clearly depicts the interrelationship between the pull lever 16, the axle 36 and the cam 32–34, as well as the interrelationship with the slide 30. Axle 36 is mounted within a bore in pull lever 16 such that the movement of latch pull lever 16 causes axle 36 to rotate, thereby actuating the cam 32–34, moving the slide against its hinge to unlatch the device. As best seen in this view, the only possible way for liquid to pass through the latch is to seep through the bores in the body 2, where the axle 36 passes through it.

FIG. 7 depicts a similar latch as in FIG. 1, however, a lock 38 has been added.

FIG. 8, a section through the latch of FIG. 1, again illustrates the interrelationship of the various elements and also discloses the compression spring 38 which urges slide 30 and the latch 34 to the latched position.

FIG. 9 depicts the unitary axle cam including the axle 36, which is secured in place by screw 28 (not shown) of the cam 32–34 to again compress spring 38 to unlatch the device.

Thus, as can be seen, the present invention discloses a very simple device while securing the closure such as a door on a boat or the like, and yet prevents the in flow of water during high seas or during the scrub down period.

What is claimed is:

1. A water resistant latch for use with a closure element, said latch operable from both sides of the closure element, comprising:

a substantially cylindrical main body portion extending through the closure element, having an outwardly facing water impervious surface, said surface including a closure element abutting peripheral flange and an inwardly extending depressed center portion;

a pull lever hingedly mounted within the depressed center portion, said pull lever rigidly mounted to an axle cam extending outwardly of the pull lever on both ends and pivotably mounted to the sides of the depressed center portion, at least one end of the axle cam extending through the side and including an actuator, whereby said actuator is axially offset from the base of the pull lever to be outside of the main body portion;

a slide latch slideably mounted within the main body portion behind the depressed center portion to latch the closure element, said slide latch selectively actuated by the actuator, such that the latch is substantially water resistant when the latch is mounted with the axle cam in a horizontal position; and a securement plate interior of the closure element to retain the latch to the closure member.

2. A latch as in claim 1 and further including a locking element.

3. A water-resistant slam-latch for use on a vessel subjected to frequent water exposure comprising:

a cylindrical main body portion including a radially outwardly extending flange to be placed in a pre-bored opening extending through a closure element wherein the main body portion presents a substantially water-resistant, outwardly facing exposure;

a latch means interior of the closure element, and means exterior of the main body portion to operate the latch means; and a backing plate interior of the closure element to hold the main body portion in position.

* * * * *